US005560594A

United States Patent [19]

Gösslinghoff

[11] Patent Number: 5,560,594

[45] Date of Patent: Oct. 1, 1996

[54] APPARATUS FOR PROCESSING PRINTED PRODUCTS

[75] Inventor: Reinhard Gösslinghoff, Wetzikon, Switzerland

[73] Assignee: Ferag AG, Switzerland

[21] Appl. No.: 444,267

[22] Filed: May 18, 1995

[30] Foreign Application Priority Data

May 20, 1994 [CH] Switzerland ..... 1566/94

[51] Int. Cl.[6] ..... B65H 5/30; B65H 29/20

[52] U.S. Cl. ..... 270/52.24; 270/58.22; 270/58.07; 271/3.07; 271/11; 271/315

[58] Field of Search ..... 270/55, 57, 58; 271/3.07, 9.07, 9.12, 9.13, 11, 12, 315

[56] References Cited

U.S. PATENT DOCUMENTS

| | | | |
|---|---|---|---|
| 1,833,311 | 11/1931 | Winkler et al. | 270/57 |
| 2,163,572 | 6/1939 | Crosby | 270/57 X |
| 3,552,740 | 1/1971 | Hepp | 271/12 |
| 3,926,427 | 12/1975 | Moksnes et al. | 270/58 X |
| 3,951,399 | 4/1976 | Reist . | |
| 4,058,202 | 11/1977 | Reist et al. . | |
| 4,127,262 | 11/1978 | Eberle et al. | 271/12 |
| 4,331,327 | 5/1982 | Felix | 270/58 X |
| 4,416,448 | 11/1983 | Meier . | |
| 4,537,391 | 8/1985 | Watkiss et al. . | |
| 4,555,101 | 11/1985 | Stobb | 271/12 X |
| 4,813,662 | 3/1989 | Merwarth et al. | 271/11 X |
| 4,981,291 | 1/1991 | Honegger et al. . | |
| 4,988,086 | 1/1991 | Schlough | 270/55 |
| 5,052,666 | 10/1991 | Hänsch . | |
| 5,080,341 | 1/1992 | Luthy | 271/12 X |
| 5,094,438 | 3/1992 | Reist et al. . | |
| 5,104,108 | 4/1992 | Honegger . | |
| 5,106,070 | 4/1992 | Reist | 271/12 |

FOREIGN PATENT DOCUMENTS

| | | | |
|---|---|---|---|
| 031717 | 7/1981 | European Pat. Off. . | |
| 83201 | 7/1983 | European Pat. Off. . | |
| 384119 | 8/1990 | European Pat. Off. . | |
| 2359773 | 2/1978 | France . | |
| 637087 | 7/1983 | Switzerland . | |
| 538783 | 1/1977 | U.S.S.R. | 271/11 |
| 2046717 | 11/1980 | United Kingdom . | |
| 2103584 | 1/1983 | United Kingdom | 271/12 |

*Primary Examiner*—John E. Ryznic
*Attorney, Agent, or Firm*—Brinks Hofer Gilson & Lione

[57] ABSTRACT

Stacks of part-products are arranged on the circumference of a rotating processing drum that has radial receiving compartments that open along the drum circumference. Rotatable rollers are provided in the region of the introduction opening of each receiving compartment on which the stacks of part-products are supported. Each stack has a separating device with a suction head separating member that seizes the bottom part-product in the stack and moves it to a location between the rollers of successive receiving compartments. The part-product that has been seized, in this manner, is fully detached from the stack by the roller and is deposited into the corresponding receiving compartment where it can be processed. For example, the part-product can be folded or cut at the borders, and assembled with other part-products by collating or inserting to form a multi-part end product.

16 Claims, 6 Drawing Sheets

APPARATUS FOR PROCESSING PRINTED PRODUCTS

BACKGROUND OF THE INVENTION

The present invention relates to an apparatus for processing printed products having receiving compartments that circulate along a continuous path and are arranged one behind the other in the direction of movement. The receiving compartments are separated by walls that extend transverse to their direction of movement and include opening for the introduction of components of the final product. At least one stationary feeding station, that accommodates a stack of printed products, is located in the movement path of the receiving compartments. The stationary feeding station has an open bottom, and the stack of printed products rests on roller supports that are carried by and move along with the receiving compartments. The stationary feeding station includes a separating mechanism, that is associated with the roller supports, for periodically removing a single printed product from the bottom of the stack.

In the prior art, such as the apparatus disclosed in European Application EP-A-0384119, a plurality of sheet material assemblers are linked together and move along a horizontal continuous path. Stacks of sheet material are disposed in stationary bottomless hoppers that overlay the path of the sheet material assemblers. The stacks of sheet material are supported by circulating belts that overlie receiving compartments of the material assemblers. The circulating belts are driven in the opposite direction but at the same speed as the receiving compartments. Rotating suction heads, are provided in the region of the discharge roller of the circulating belt that seize the bottom product in the stack, and convey the seized product away from the stack and deposit it into the associated receiving compartment. The suction heads, moving along with the receiving compartments, must be periodically connected to a vacuum source and subsequently provided with air under pressure. Thus, in this prior art apparatus the individual sheet material assemblers as well as the conveyor mechanism are very complex and are constructed of a large number of components.

The object of the present invention, is to provide an apparatus of the type mentioned in the introduction of this section, in which the number of components that move along with the receiving compartments is kept as low as possible, and said components are of a simple design.

For the foregoing reasons, there is a need for a machine that can inexpensively process printed products in a more economical, reliable and simpler manner.

SUMMARY OF THE INVENTION

The present invention is directed to an apparatus that satisfies these needs. The apparatus comprises a roller arrangement for supporting the stack of sheet material and an associated separating member arranged between rollers of the roller arrangement. The separating member grasps a specific region of the bottom sheet material of the stack and moves it between the rollers. The bottom sheet material of the stack is then fully detached from the stack by the rollers. The rollers continue to serve as supports for the stack while located between the bottom sheet material that has been seized and moved away from the bottom of the stack, by the separating member, and the next printed product in the stack.

In the apparatus according to this invention, the components that move along with the receiving compartments are thus limited to the rollers of the roller arrangements, which, function as supports for the stack and as part of the separating arrangement for detaching the printed products from the stack and the remainder of the separating arrangement.

DETAILED DESCRIPTION OF THE PRESENTLY PREFERRED EMBODIMENTS

Figure 1:
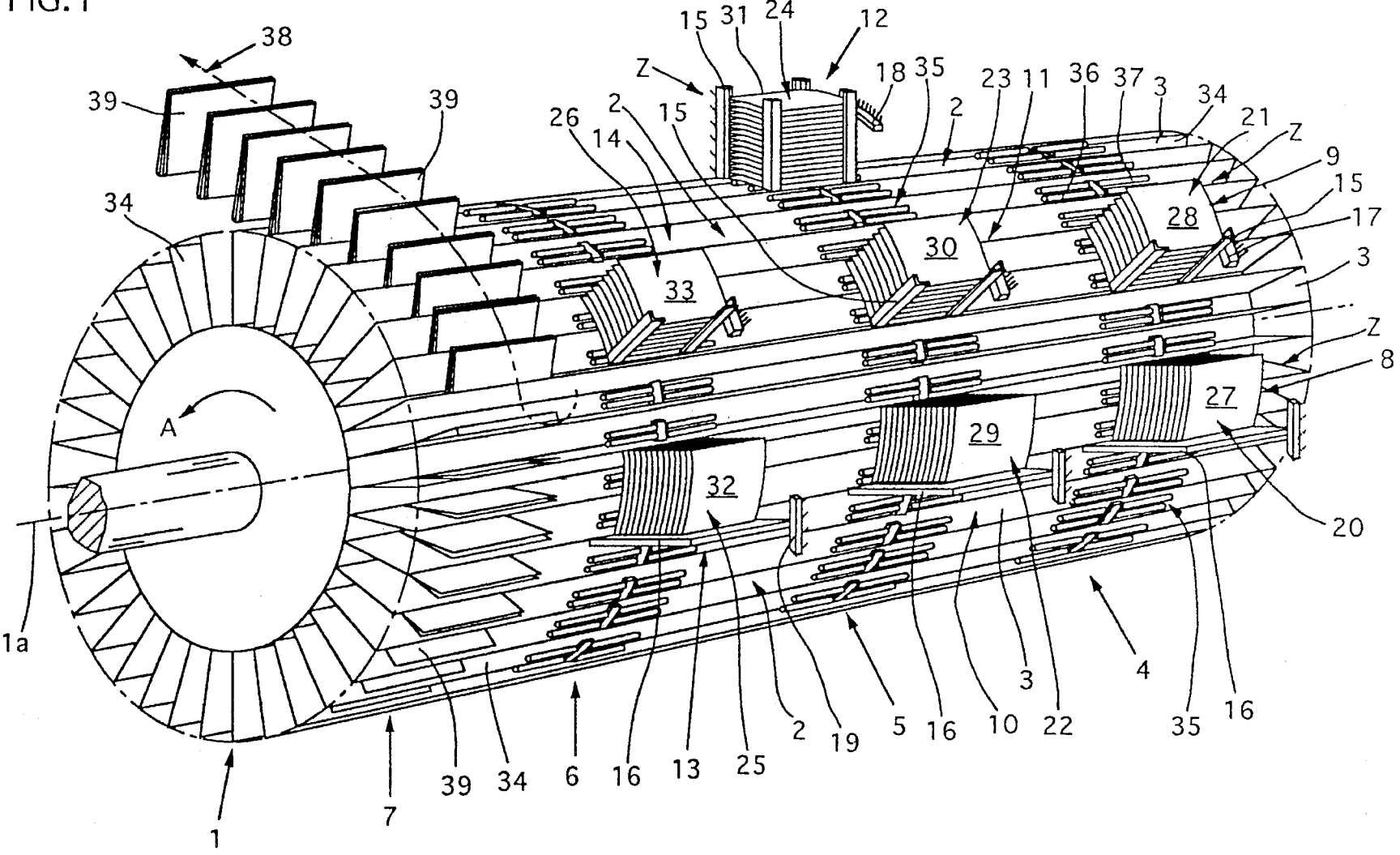
FIG. 1 is a perspective view of a processing drum for producing multi-part printed products according to this invention.

The apparatus shown in FIGS. 1–5 is intended for producing multi-part printed products and includes a processing drum 1 which is rotatably driven about its longitudinal axis la in the direction of arrow A. The processing drum 1 has radial receiving compartments 2 that are open along the circumference of the processing drum 1 and have an introduction opening 3. The processing drum 1 is subdivided, along its longitudinal axis la, into three feeding sections 4, 5 and 6 and a removal section 7.

By using the processing drum 1, multi-part end products can be brought together in manners known as inserting or collating. The printed products, hereinafter referred to as part-products, fed to the feeding sections 4, 5, 6 in a manner to be described, are advanced along the longitudinal axis 1*a* of the drum 1 in a known manner. When part-products are inserted into a main product, the main products must be opened, which is done in a known manner and is not disclosed in detail in this application. For a detailed disclosure of the above-mentioned advancement of the products along the longitudinal axis and of the opening of the main products, reference may be had to the following: U.S. Pat. No. 3,951,399 and the corresponding DE-A-2447336; U.S. Pat. No. 4,058,202 and the corresponding DE-A-2604101; U.S. Pat. No. 5,052,666 and the corresponding EP-A-0341424; and U.S. Pat. No. 4,981,291 and the corresponding EP-A-0341423. All of these U.S. Patents are hereby incorporated by reference as a part of this disclosure.

The processing apparatus according to the subject invention differs from the known processing apparatuses in the new and unique manner of feeding the part-products to the individual receiving compartments 2 of the processing drum 1. This new and unique manner of feeding will be explained with reference to FIGS. 2–5.

Arranged in each feeding section 4, 5 and 6 of the processing drum 1 is one or more feeding stations Z, which exhibit a stack chamber 8, 9, 10, 11, 12, 13, 14 or R. In the case of the embodiment shown in FIG. 1, two or more feeding stations Z are provided, one behind the other along the direction of rotation A of the drum 1, in each feeding section 4, 5, 6. The stack chambers 8, 9, 10, 11, 12, 13, 14, R are bounded, as shown, by rails 15 and/or rests 16. The rails 15 and rests 16 are retained in a stationary manner by means of fastening rings 17, 18, 19 or B. Each stack chamber 8, 9, 10, 11, 12, 13, 14, R serves to receive a stack 20, 21, 22, 23, 24, 25, 26 or S of single-sheet or multi-sheet, folded or stapled part-products 27, 28, 29, 30, 31, 32, 33 or T. The stack chambers 8–14, R are open at the bottom. Roller arrangements 35 which comprise rollers 36, 37 which are rotatably fastened on the compartment walls 34 that separates the receiving compartments 2 from one another. Roller arrangement 35 serves to support the stacks 20–26, S. The configuration of the roller arrangements 35 will be discussed in more detail with reference to FIGS. 4 and 5.

As seen in FIG. 1, a removal conveyor 38, shown schematically, is provided in the region of the removal section 7 of the processing drum 1. This conventional transporter has grippers that are arranged one behind the other along the conveying direction, seize the end products 39 and guide them away from the receiving compartments 2 of the removal section 7.

Figure 2:
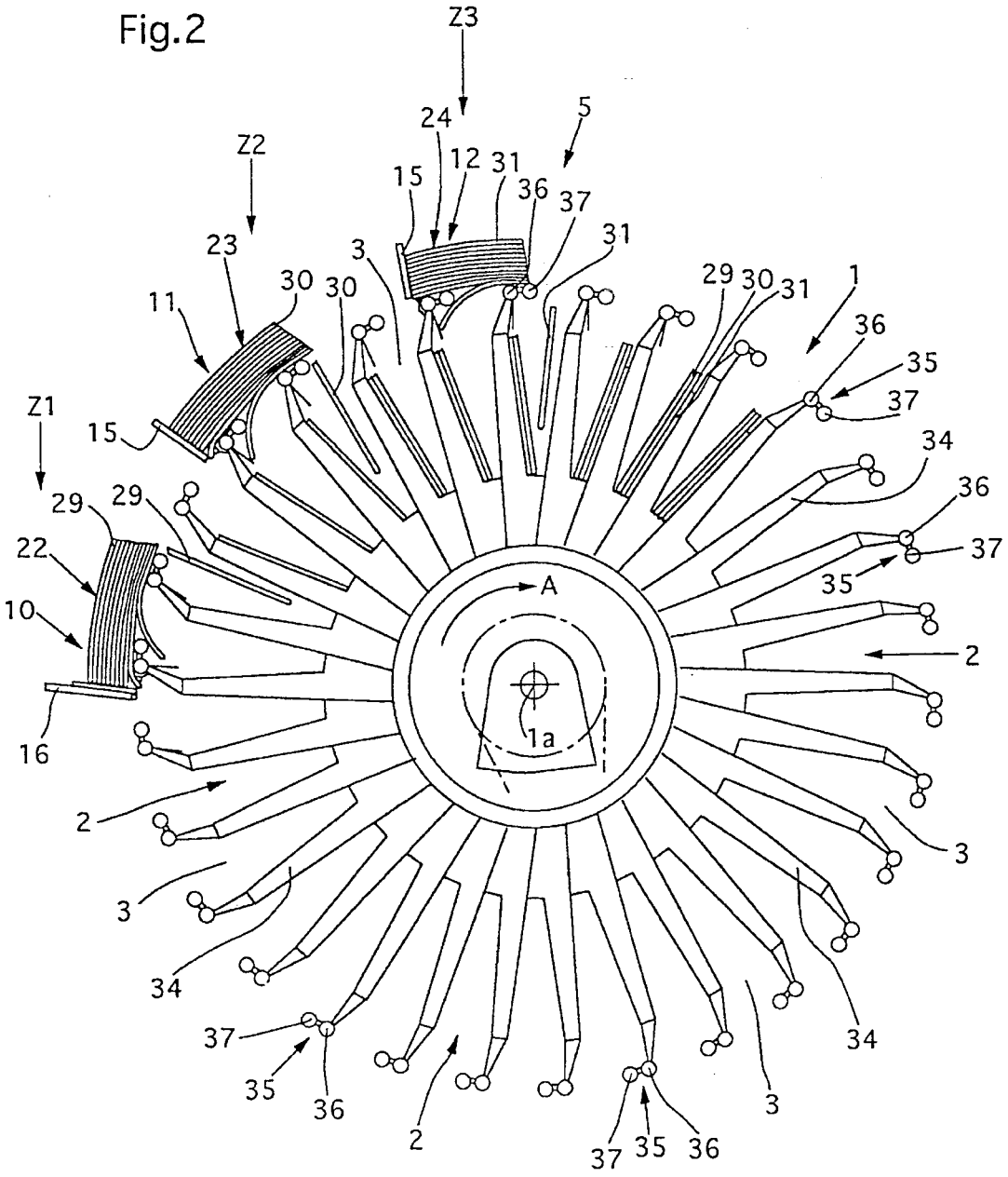
FIG. 2 is a view, along the longitudinal axis, of a feeding section of the processing drum shown in FIG. 1.
Figure 3:
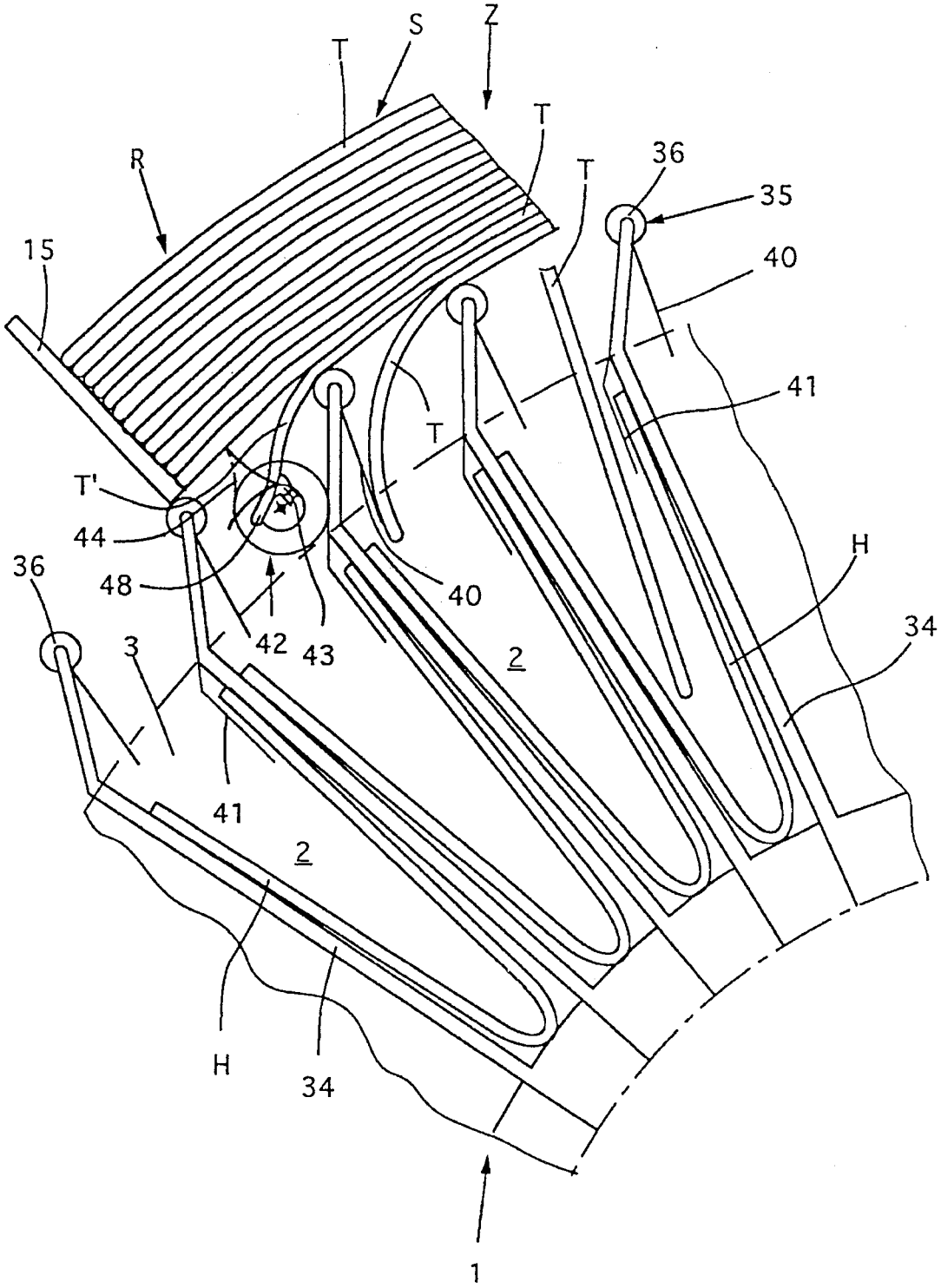
FIG. 3 is a view, on a larger scale than FIG. 2, of the feeding section of the processing drum and a feeding station.

As can be seen in FIGS. 1–3, the rollers 36, 37 of the roller arrangements 35 are arranged in the region of the introduction openings 3 along the circumference of the processing drum 1. The roller arrangements 35 are constructed and located such that the stacks 20–26, S that are in engagement with the rollers 36, 37 are supported thereby. As can be seen in FIGS. 1–3, the stacks 20–26, S are in engagement with at least two of the roller arrangements 35 adjacent a receiving compartment 2.

It should be noted that a first embodiment of the roller arrangement is shown in FIGS. 1 and 2, and a second embodiment is shown in FIG. 3.

In the embodiment shown in FIGS. 1 and 2, each roller arrangement 35 has two parallel rollers 36, 37, whereas only one roller 36 is provided in the embodiment shown in FIG. 3. It should be understood that each roller arrangement 35, depending on the design and number of the receiving compartments 2 and the width of the introduction openings 3, could have one, two or a plurality of rollers.

FIGS. 2 and 3 also differ further in how the end products are assembled. FIG. 2, illustrates a process in which the part-products are collated to form the end product. FIG. 3 illustrates a process in which the part-products are inserted into an open main product H.

As is shown in FIG. 3, deflecting elements 40 are provided in the region of the introduction openings 3. Deflecting elements 40 serve to guide the part-products T, that have been detached from the stack S, into the corresponding receiving compartment 2. The deflecting elements 40, can be pivotally connected to the compartment walls 34. FIG. 3 also shows retaining elements 41 that are fastened to the compartment walls 34. Retaining elements 41 function to hold a part of the open main product H to ensure that the main product H remains open.

A stationary separating arrangement 42 is provided for each feeding station Z, i.e. for each stack chamber 8–14, R. The separating arrangement 42 is shown schematically in FIG. 3 and is not shown in FIGS. 1 and 2. As shown in FIG. 3, the separating arrangement 42 includes a separating member 43 that includes a suction head 43'. The suction head 43' moves along a continuous hypocycloid movement path 44. The construction of a separating arrangement 42 will be described in more detail with reference to FIGS. 4 and 5.

Figure 4:
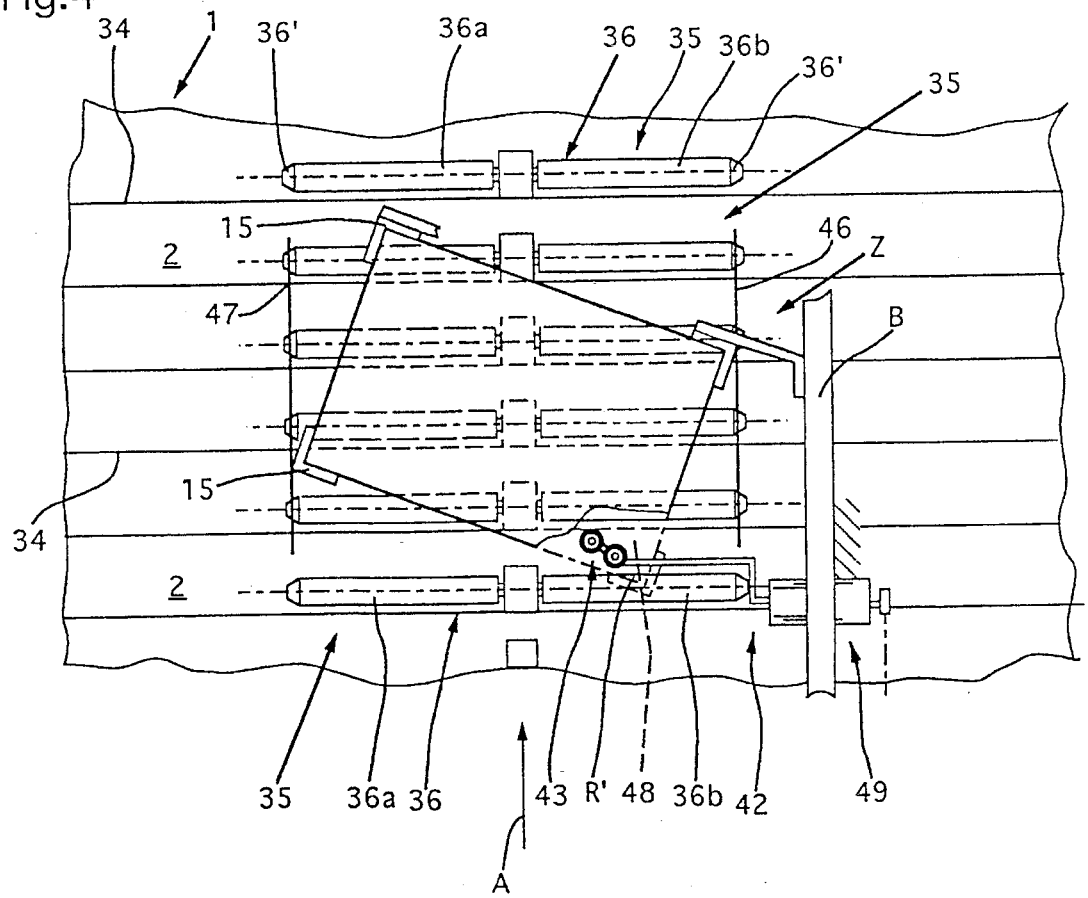
FIG. 4 is a plan view of a portion of the processing drum and a feeding station.
Figure 5:
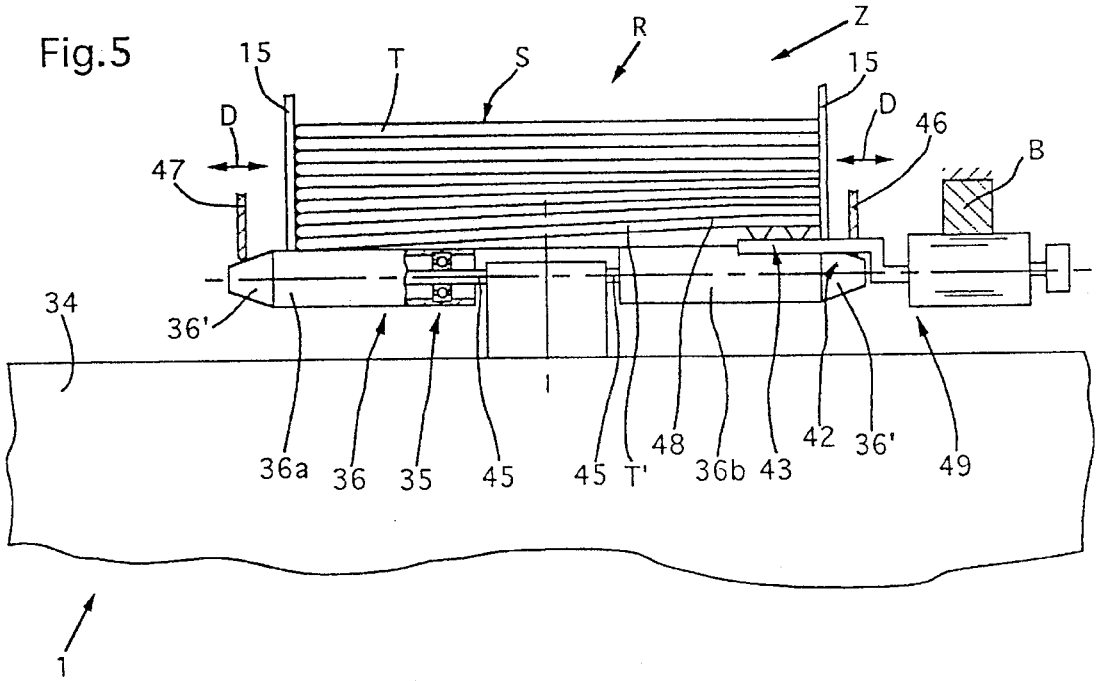
FIG. 5 is a side view of the feeding station seen in FIG. 4.

The embodiment of the roller arrangements 35 illustrated in FIGS. 4 and 5, has only one roller 36. Roller 36 is divided into two halves **36*a* and 36*b*. Each roller half 36*a*, 36*b* is rotatably mounted on a spindle 45 which is fastened to a compartment wall 34 (FIG. 5). At their free, conically shaped end 36', the roller halves 36*a*, 36*b* are in contact with friction strips 46 and 47 which are fixedly mounted in the region of the stack chamber R. As the roller halves 36*a*, 36*b*, move past the compartment walls 34 in a feeding station Z, they are caused to rotate about their longitudinal axis as a result of their frictional engagement with the friction strips 46, 47. By adjusting the friction strips 46, 47 in the direction of the double arrow D, the circumference speed of the friction roller halves 36*a*, 36*b*** can be varied within certain limits.

As best seen in FIG. 4, stack chambers 8–14, R are positioned obliquely to the movement direction A of the rollers 36. In the region of a corner R' of stack chamber R, the suction heads 43' grasp the lowermost part-product T", in a region designated 48. The suction heads 43' may be provided with one or more suction devices. The suction heads 43', are connected to a drive device 49. The suction heads 43' are carried by a lever the other end of which is guided by a follower/guideway arrangement. The lever is eccentrically anchored to a planetary gear that follows a circular path around a ring gear. Through this drive mechanism the suction heads 43' are caused to follow the continuous hypocycloid movement path 44 shown in FIGS. 3, 6, 7 and 8. The drive device 49 is carried by the fastening ring B. For a complete disclosure of the construction and the mode of operation of the drive device 49 and the manner in which the suction heads 43 move, reference may be made to U.S. Pat. No. 4,127,262 and the corresponding CH-A-598106 and to U.S. Pat. No. 5,106,070 and the corresponding EP-A-0417503 application. The suction heads 43' are connected to a vacuum source (not shown) as they pass through part of their movement path 44. This can preferably take place in the manner described in U.S. Pat. No. 4,279,412 and the corresponding CH-A-626589, which are hereby incorporated by reference as a part of this disclosure.

A detailed description of the operation of the separating arrangements 42 and the detachment of the lowermost part-product T' from the stack S, is also provided in U.S. Pat. No. 4,279,412 and the corresponding CH-A-626589.

Figure 6:
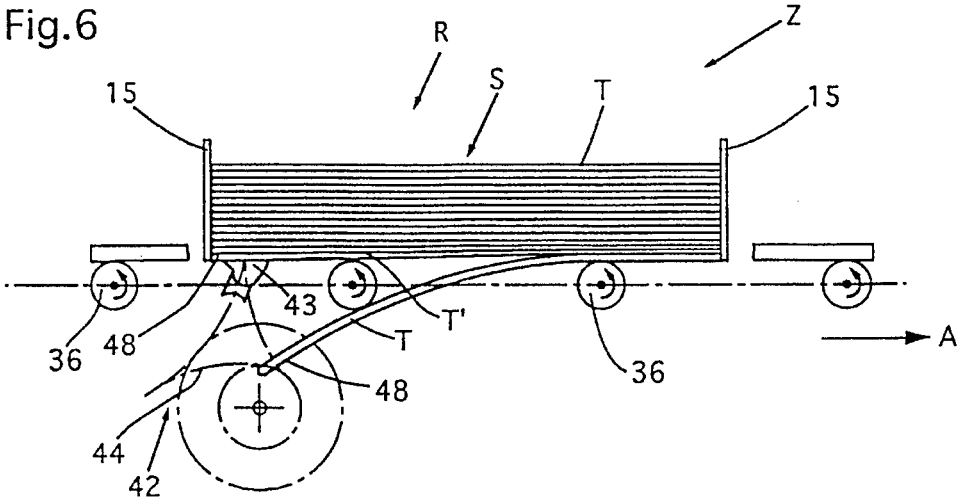
FIGS. 6–8 are schematic views of a sequence, which follow one after the other, that occurs at the feeding station.
Figure 7:
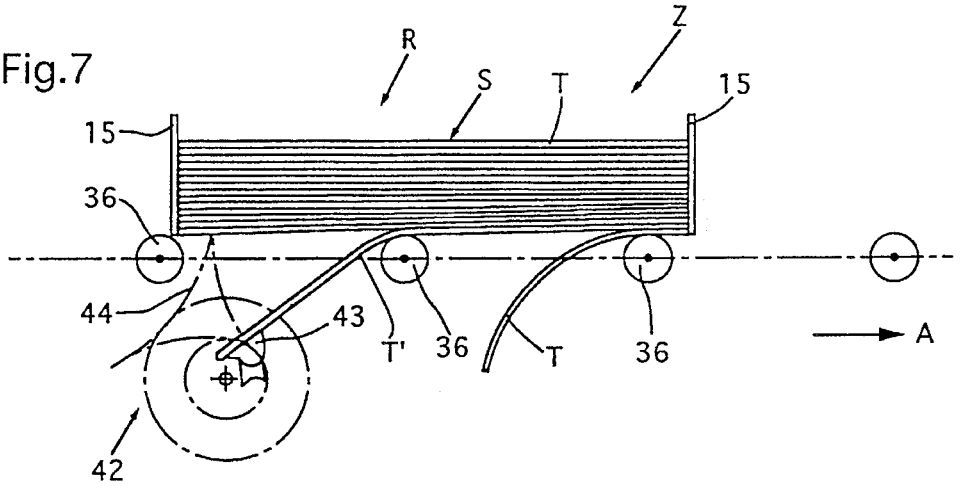
Figure 8:
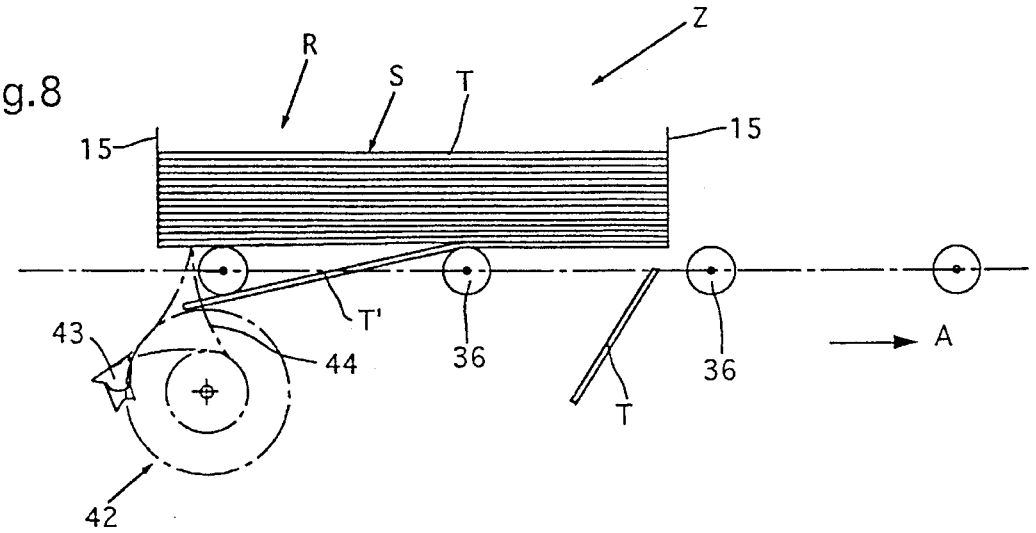

In FIGS. 6–8, a sequential series of operating phases are shown, the operation of detaching the lowermost part-product T' from the stack S is discussed, with reference also being made to FIGS. 2–5.

As previously discussed, the stacks 20–26, S are supported on the roller arrangements 35 that are located adjacent the receiving compartments 2. The rollers 36, 37 of the roller arrangements 35 engage the underside of the stacks 20–26, S and roll along the underside of the stacks in the process. In addition, the rollers 36, 37 are rotatably driven as was described with reference to FIGS. 4 and 5. The suction head 43' is displaced periodically between successive rollers 36 and seizes the lowermost part-product T' in the stack S in the corner region 48 which is directed toward an oncoming roller 36 (FIG. 6). The vacuum to the suction head 43' is on at the location shown in FIG. 6. Subsequently, the suction head 43', connected to the vacuum source, moves away from the underside of the stack S, following the first leg of its hypocycloid path. During this first leg of its path the seized region 48 of the lowermost part-product T' is moved to the location shown in FIG. 7, between the central and left rollers 36. The left roller 36 then moves into the interspace thereby formed and moves along the underside of the stack S. The part-product T' seized by the suction head 43' is then released by switching off the vacuum source to the suction head 43'. The suction head 43' then moves along the second leg of its hypocycloid path, which is counter to the movement direction A of the rollers 36 (see FIG. 8). Thereafter, the suction head 43' moves again, along the third leg of its hypocycloid path in the direction towards the underside of the stack S, to the position seen in FIG. 6 between the next two rollers 36. The vacuum to the suction head 43' is then turned on and the next part-product T is separated from the stack S in the manner previously described.

With reference to FIG. 3, the manner in which the lowermost part-product T' is grasped by the suction head 43' and then fully detached from the stack S, by the rollers 36 will be discussed. The speed at which the suction heads 43' are moving is equal to the circumferential speed of the receiving compartments 2 such that, each time the introduction opening 3 of a receiving compartment 2 comes into the region of the separating arrangement 42, the lowermost part-product T' is seized in the region 48 by the suction head 43' and is moved away, from the underside of the stack to a location between successive rollers 36.

The collation of the end products 39 using the apparatus shown in FIG. 1 proceeds as follows:

Each time a receiving compartment 2 moves past a feeding station Z, the respectively lowermost part-product T' is detached from the stack 20–26, S and inserted into the receiving compartment 2 through the introduction opening 3. In the first feeding section 4, two part-products 27 and 28 are inserted, bearing one against the other, into a receiving compartment 2. Subsequently, said two part-products 27, 28 are advanced, in the direction of the drum longitudinal axis 1*a*, into the second feeding section 5, in which three further part-products 29, 30 and 31 are deposited in each receiving compartment 2, as is shown in greater detail in FIG. 2 (in FIG. 2, however, the two part-products 27 and 28 from the first feeding section 4 are not shown). Thereafter, the part-products 27–31, located one upon the other, are advanced into the third feeding section 6, in which the part-products 32 and 33 are added. The end product 39, comprising the part-products 27–33 bearing one against the other, is displaced into the removal section 7. The removal conveyor 38 removes the end products 39 from the removal section 7 and guides said end product 39 away for further processing.

When the apparatus shown in FIG. 1 is used for insertion operation, then the part-product 27 drawn off from the first stack 20 in the first feeding section 4 must be opened before the next part-product, as is shown in FIG. 3, is inserted into the open main product H. The opening of the part-product 27 is disclosed in detail in the above mentioned U.S. Pat. Nos. 3,951,399, 4,058,202, 4,981,291 and 5,052,666. The opening of the first part-product 27 and/or of the main product H takes place preferably during advancement into the second feeding section 5. In this case, the second feeding station with the stack chamber 9 in the first feeding section 4 can be dispensed with.

Figure 9:
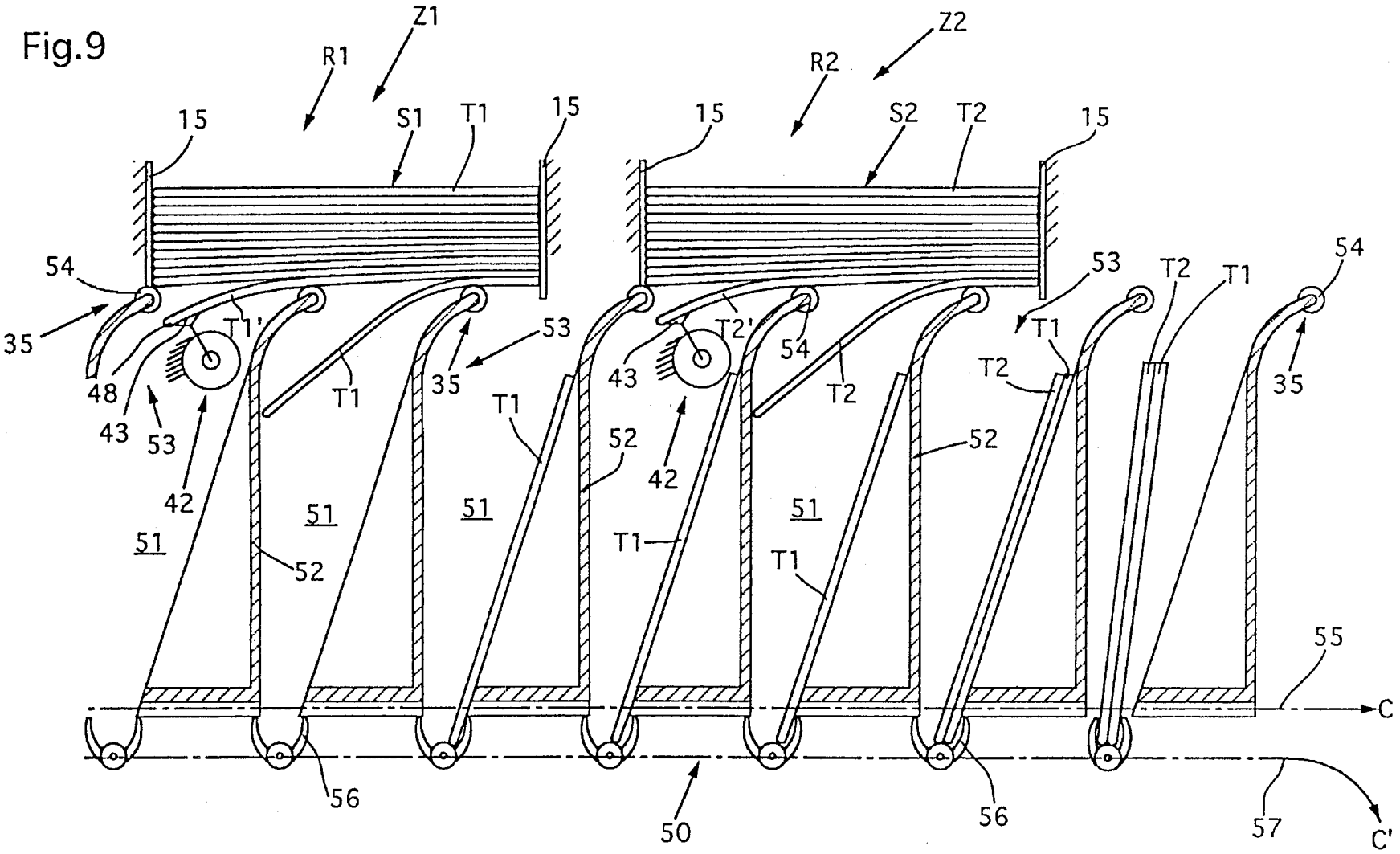
FIG. 9 is a side view of part of another embodiment of a processing apparatus for producing multi-part printed products.

FIG. 9 shows another embodiment of a processing apparatus 50, which, also discloses individual receiving compartments 51. The individual receiving compartments 51 are separated from one another by compartment walls 52 that extend transverse to the direction of movement C of the receiving compartments 51. In the region of the introduction openings 53 of the receiving compartments 51 there are arranged, on the compartment walls 52, rotatable rollers 54 which correspond to the rollers 36, 37 of the embodiment according to FIGS. 1–3. The receiving compartments 51 are fastened to an endless belt member 55, that is shown schematically. The endless belt member 55 is guided over deflection rollers (not shown). As a result the receiving compartments 51 also circulate along a continuous movement path. The receiving compartments 51 are open at the bottom, the openings being closed off by gripper clamps 56. Said gripper clamps 56 are fastened to an endless belt member 57, which circulates in the direction of the arrow C' at the same speed as the receiving compartments 51. As seen in FIG. 9 there are arranged above the receiving compartments 51, feeding stations Z1 and Z2. These feeding stations Z1 and Z2 are of the same construction as the feeding stations Z shown in FIGS. 1–8 and include a stack chamber R1 or R2, respectively, which is secured by rails 15. Said stack chambers R1 and R2 serve to receive in each case one stack S1 and S2, respectively, of part-products T1 and T2, respectively. These stack chambers R1 and R2 are also positioned obliquely as shown in FIG. 4. There are in the corners of the stack chambers R1 and R2, that are directed towards the oncoming rollers 54, separating arrangements 42 that have a suction head 43'.

The stacks S1, S2 in the downwardly open stack chambers R1, R2 are supported on the passing rollers 54, as previously described. The detachment of the lowermost part-product T1', T2" from the stack S1, S2 occurs, as will be discussed with reference to FIG. 9. The bottom edges of part-products T1, T2 that are drawn off from the stacks S1, S2 enter the open gripper clamps 56. The gripper clamps 56 are closed when the end product has been completely assembled and then functions to draw the end product out of the receiving compartments 51.

It is, however, also possible to remove the finished end products upwards, instead of downwards, from the receiving compartments 51, e.g. as is shown in FIG. 1 using a transporter with grippers.

For a detailed description of processing apparatuses with circulating receiving compartments 51, reference may be had to U.S. Pat. No. 5,104,108 and the corresponding EP-A-0346578 application.

It should also be noted that, when using the apparatus shown in FIG. 9, the end products can be produced both by collating or by inserting (in accordance with the representation of FIG. 3).

Using the processing drum 1 shown in FIG. 1, two products can be inserted simultaneously, as is described in more detail in U.S. Pat. No. 4,416,448 and the corresponding DE-A-3143026. In this embodiment of the invention, one main product H is detached from the two stacks 20 and 21 in the first feeding section 4, opened and then provided with further part-products T.

In another embodiment using the processing drum 1, the part-products or the finished end products can be trimmed at the side borders and/or folded once or twice.

In another embodiment using the processing drum 1 according to FIG. 1 and the processing apparatus 50 of FIG. 9, a folded product is deposited in a straddling manner over the multi-part intermediate products at the end of the collating or insertion operation, as is described in U.S. Pat. No. 5,094,438 and the corresponding EP-A-0354343 application. Finally, in another embodiment using the processing drum 1 and having only one feeding section with a plurality of feeding stations Z, the finished end products are removed downstream of the last feeding station. In this embodiment the part-products in the receiving compartments do not have to be displaced along the drum longitudinal axis 1*a*.

In the previously disclosed embodiments using the processing drum 1 of FIG. 1, feeding of the part-products 27–33 in all the feeding sections 4, 5, 6 takes place from the stacks 20–26. It should, however, be noted that it is also possible, in certain feeding sections, to feed the part-products in different manners, that are know in the art such as feed conveyors provided with grippers.

By optionally engaging and disengaging the separating arrangements 42 of certain feeding stations Z, for example by controlled connection of the vacuum source to the suction heads 43', different types of end products may be produced while using the apparatus according to FIG. 1 or FIG. 9. In other words, the suction head 43' of certain feeding stations Z can be deactivated, when in the vicinity of certain receiving compartments 2, 51, which will have the result that no part-product will be introduced into the passing receiving compartment at this feeding station Z.

In the simplest embodiments of the invention, there is only one feeding station, for example feeding station Z1, in the embodiment according to FIG. 9, or feeding section 5, with only one feeding station Z in the case of the processing drum 1 according to FIG. 1. Accordingly, in these simple embodiments the processing drum 1 would differ from the embodiment shown in FIG. 2 in that there would be only one feeding station, for example the feeding station Z1, with associated separating arrangement.

The printed products T that are introduced into the receiving compartments 2, 51 can then be processed in said receiving compartments 2, 51, by folding or cutting at the borders.

In these simple embodiments with only one feeding section with a feeding station Z, the processed printed products can be removed from the feeding section at the end of the processing path. It is, however, also possible to provide a removal section next to the feeding section. In this situation the printed products in the receiving compartments 2 will be displaced from the feeding section into the removal section.

It is intended that the accompanying drawings and foregoing detailed description is to be considered in all respects as illustrative and not restrictive, the scope of the invention is intended to embrace any equivalents, alternatives, and/or modifications of elements that fall within the spirit and scope of the invention, and all changes which come within the meaning and range of equivalency of the claims are therefore intended to be embraced therein.

I claim:

1. An apparatus for processing printed products, of the type comprising;

receiving compartments that circulate along a continuous path and are arranged one behind the other in the direction of their movement, said receiving compartments being separated from one another by walls that extend transverse to their direction of movement and include introduction openings for the introduction of part-products;

a stationary feeding station, located adjacent to the movement path of said introduction openings, for feeding printed products to said receiving compartments through said introduction openings, said stationary feeding station having a downwardly open stack chamber for receiving a stack of printed products;

a support associated with and movable along with each receiving compartment, said support being located below said stack chamber such that the underside of said stack of printed products bears on said support; and a separating member for periodically detaching a printed product from the stack and depositing it into said receiving compartment through said introduction opening;

said support comprising a roller arrangement, including a rotatable roller carried by a compartment wall and located in the region of the introduction opening, such that it makes direct contact with the bottom printed product of the stack, and rolls over the underside of the stack; and said separating member being carried by said stationary feeding station and including a drive device that can cause said separating member to move along a continuous movement path such that it can be displaced between the rollers of two successive roller arrangements and can be moved against the lowermost printed product in the stack, seizes said lowermost printed product and moves the seized region thereof away from the underside of the stack and between the rollers of the successive roller arrangements and then releases said seized lowermost printed product.

2. An apparatus according to claim 1, wherein the separating member seizes a region of the lowermost printed product that has not been engaged by said rotatable roller at a time when said rotatable roller is about to run under the stack.

3. An apparatus according to claim 2, wherein the stack is positioned obliquely to the movement direction of said rotatable roller such that it is oriented such that one of its corners is the region that is seized by said separating member.

4. An apparatus according to claim 1, wherein the separating member includes a suction head that can be periodically connected to a vacuum source.

5. An apparatus according to claim 1, wherein said rotatable roller is rotatably driven when it is in the region of the stack chamber.

6. An apparatus according to claim 5, wherein said rotatable roller is driven by the frictional engagement of said rotatable roller along a stationary rail.

7. An apparatus according to claim 1, comprising a plurality of stationary feeding stations adjacent to the movement path of said introduction openings of the receiving compartments, each of said stationary feeding stations having a downwardly open stack chamber for receiving a stack of printed products and an associated separating member.

8. An apparatus according to claim 7, comprising feeding stations are arranged one behind the other in the movement direction of said receiving compartments.

9. An apparatus according to claim 1, wherein said apparatus comprises a processing drum that is rotatably driven about its longitudinal axis, said processing drum including radially opening and axially extending receiving compartments, and said processing drum having at least one feeding section that has at least one feeding station.

10. An apparatus according to claim 9, wherein said processing drum has at least two feeding sections and each feeding section has at least one feeding station, said processing drum including an advancement device for advancing said printed products along the longitudinal axis of said processing drum from said receiving compartments in said first feeding section to receiving compartments in said second feeding section.

11. An apparatus according to claim 10, wherein said processing drum includes devices for opening printed products that have been deposited in receiving compartments of said first feeding section, during their advancement into said second feeding section.

12. An apparatus according to claim 1, wherein said apparatus comprises an endless belt to which said receiving compartments are fastened, said endless belt being driven in circulation, a feeding station being located along the movement path of the receiving compartments.

13. An apparatus according to claim 1, wherein said receiving compartment includes a folding mechanism for said printed products.

14. An apparatus according to claim 1, wherein said receiving compartment includes a cutting mechanism for said printed products.

15. An apparatus according to claim 13, wherein said receiving compartment includes a cutting mechanism for said printed products.

16. The method of processing printed products comprising the steps of:

(a) circulating receiving compartments along a continuous path;

(b) arranging said receiving compartments one behind the other along their direction of movement;

(c) separating said receiving compartments from one another by walls that extend transverse to their direction of movement;

(d) providing introduction openings in said receiving compartments for the introduction of part-products;

(e) locating a stationary feeding station adjacent to the movement path of said introduction openings;

(f) feeding printed products from said stationary feeding station to said receiving compartments through said introduction openings;

(g) providing said stationary feeding station with a downwardly open stack chamber for receiving a stack of printed products;

(h) providing a support in the form of a rotatable roller carried by the receiving compartment wall below said stack chamber and in the region of the introduction opening such that the bottom printed product of said stack bears on said support;

(i) providing a separating member on said stationary feeding station that seizes the bottom printed product from the stack and moves the seized printed product away from the underside of the stack to a position between successive rotatable rollers; and (j) releasing said seized bottom printed product.

* * * * *